United States Patent [19]

Deland

[11] Patent Number: 4,690,113

[45] Date of Patent: Sep. 1, 1987

[54] INTERNAL COMBUSTION ENGINE

[76] Inventor: Olivier Deland, 821 Normandie, No. 18, St. Jean, Quebec, Canada, J3A 1K6

[21] Appl. No.: 857,499

[22] Filed: Apr. 30, 1986

[51] Int. Cl.[4] ..... F02B 75/32

[52] U.S. Cl. ..... 123/197 AC; 123/52 A; 123/78 E; 123/54 B

[58] Field of Search ..... 123/197 R, 197 A, 197 AB, 123/197 AC, 78 R, 78 F, 78 E, 54, 48 R, 48 B, 52 A

[56] References Cited

U.S. PATENT DOCUMENTS

| | | | |
|---|---|---|---|
| 441,582 | 11/1890 | Quack | 123/78 F |
| 1,379,115 | 5/1921 | Mallory | 123/197 A |
| 1,384,343 | 7/1921 | Powell | 123/54 R |
| 4,505,239 | 3/1985 | Deland | 123/197 AC |
| 4,517,931 | 5/1985 | Nelson | 123/197 AC |

FOREIGN PATENT DOCUMENTS

| | | | |
|---|---|---|---|
| 453274 | 11/1949 | Italy | 123/197 AC |

*Primary Examiner*—Craig R. Feinberg

*Attorney, Agent, or Firm*—Swabey, Mitchell, Houle, Marcoux & Sher

[57] ABSTRACT

The invention relates to an engine including a cylinder defining a combustion chamber which receives a combustible mixture for the combustion thereof, a piston slidably mounted therein for reciprocation between a first limit position whereat the chamber defines its minimum and maximum volume, a pair of rotatably mounted parallel crankshafts arranged equidistantly relative to the longitudinal axis of the cylinder, each having a crank-arm rotatable about its respective crankshaft axis, and means coupling the crankshafts together for synchronizing rotation thereof with the crank-arm of one crankshaft having an angular advance over the crank-arm of the other crankshaft. According to the invention, a single-arm lever is pivotally connected at one end thereof to the piston for pivotal movement about a pivot axis extending normal to the cylinder longitudinal axis, and a pair of connecting rods interconnect the lever and the respective crank-arms of the crankshafts with one connecting rod being pivotally connected to the lever at a free end thereof and the other connecting rod pivotally connected to the lever intermediate the ends thereof. The lever with the connecting rods define a position control means for enabling the lever to pivot and move past the longitudinal axis when the piston reaches the first limit position and to maintain the piston substantially stationary at the first limit position for a time period sufficient to permit the crank-arm of the aforesaid one crankshaft to move past dead-center. Thus, substantially maximum force is transmitted to the connecting rod connected to the crank-arm having the angular advance.

12 Claims, 8 Drawing Figures

INTERNAL COMBUSTION ENGINE

BACKGROUND OF THE INVENTION

The present invention relates to improvements in internal combustion engines. More particularly, the invention is concerned with an improved position control means enabling the occurrence of dead-centers to be controlled in an internal combustion engine.

In conventional internal combustion engines, the crankshaft is usually arranged below a cylinder in a manner such that the longitudinal axis of the cylinder and the crankshaft axis lie in a common plane. Thus, when a vertically reciprocating piston which is connected to a crank-arm of the crankshaft by means of a connecting rod reaches its uppermost position, a dead-center occurs, that is, a line passing through the points of connection of the rod to the piston and crank-arm intersects the crankshaft axis. It has therefore been the practice to time the ignition so that combustion takes place when the crank-arm has moved past dead-center and is at an angular position relative to the longitudinal axis of the cylinder. As a result, there is a loss of compression in the combustion chamber defined in the cylinder such that upon combustion maximum thrust cannot be imparted to the piston. In addition, since the connecting rod is angularly inclined relative to the longitudinal axis of the cylinder when the piston is intermediate its uppermost and lowermost positions, there is a problem of friction occurring between the piston and the cylinder wall.

In U.S. Pat. No. 4,505,239 issued Mar. 19, 1985, Applicant has proposed to overcome the aforementioned drawbacks by providing a pair of rotatably mounted parallel crankshafts arranged equidistantly relative to the longitudinal axis of the cylinder and each having a crank-arm rotatable about its respective crankshaft axis, and means coupling the crankshafts together for synchronising the rotation thereof with the crank-arm of one of the crankshafts having an angular advance over the crank-arm of the other crankshaft. A rocker member is pivotally connected to the piston for rocking movement about a pivot axis extending normal to the longitudinal axis of the cylinder. A pair of connecting rods interconnect the rocker member and the respective crank-arms of the crankshafts with each connecting rod being pivotally connected to the rocker member. The rocker member together with the connecting rods define a position control means for enabling the rocker member to rock when the piston reaches the first limit position and to thereby maintain the piston substantially stationary at the first limit position for a period of time sufficient to permit the crank-arm of the aforesaid one crankshaft to move past dead-center.

Due to the provision of two crankshafts and two connecting rods indirectly connecting the crank-arms of the crankshafts to the piston via a rocker member, and by giving to the crank-arm of one crankshaft an angular advance over the crank-arm of the other crankshaft, it is possible to control the occurrence of dead-centers so as to achieve maximum compression when the piston is at the first limit position while the crank-arm which is given an angular advance is positioned past dead-center. Since the crankshafts are disposed equidistantly relative to the longitudinal axis of the cylinder, there is also substantially no friction exerted between the piston and the cylinder wall.

The rocker member used according to Applicant's above-mentioned patent comprises a pair of fixed arms extending radially from the pivot axis about which the rocker member rocks, the arms being angularly inclined relative to one another and each being pivotally connected at a free end thereof to a respective one of the connecting rods. The arms of the rocker member have different radial lengths and the connecting rods which are pivotally connected at their upper ends to these arms and at their lower ends to the respective crank-arms of the crankshafts are arranged so as to cross each other. Due to such an arrangement, the connecting rod which is connected to the shorter arm of the rocker member must be curved adjacent its upper end to provide a clearance for the longer arm of the rocker member during the rocking movement thereof. As a result, there is a structural weakness at the curved portion of the connecting rod, which must be compensated for by increasing the thickness of the rod at that location. Such a connecting rod therefore requires special designing and tooling, which add to the manufacturing cost of the engine.

The rocker member with radially extending arms is also bulky and thus only limited space is provided inside the piston within which the rocker member may rock. Moreover, since the arms of the rocker member are angularly inclined relative to one another and disposed on either side of the longitudinal axis of the cylinder, the force which is transmitted by the piston to the connecting rods via the rocker member when combustion takes place is divided into two components through the arms of the rocker member. Although the force transmitted to the connecting rod which connected to the crank-arm having the angular advance is greater than that transmitted to the other connecting rod, it would be highly desirable to further increase the force transmitted to the former connecting rod for greater efficiency of the engine.

SUMMARY OF THE INVENTION

It is therefore an object of the present invention to provide an internal combustion engine having improved position control means enabling the advantages set forth in Applicant's aforementioned patent to be retained while overcoming the drawbacks discussed above.

It is a further object of the invention to increase in an internal combustion engine of the aforesaid type the force transmitted by the piston to the connecting rod which is connected to the crank-arm having the angular advance, for greater efficiency of the engine.

In accordance with the present invention, there is provided in an internal combustion engine including a cylinder defining a combustion chamber adapted to receive a combustible mixture for the combustion thereof, a piston slidably mounted in the cylinder for reciprocating movement between a first limit position whereat the combustion chamber defines its minimum volume and a second limit position whereat the combustion chamber defines its maximum volume, a pair of rotatably mounted parallel crankshafts arranged equidistantly relative to the longitudinal axis of the cylinder and each having a crank-arm rotatable about its respective crankshaft axis, and means coupling the crankshafts together for synchronising the rotation thereof with the crank-arm of one of the crankshafts having an angular advance over the crank-arm of the other crankshaft, the improvement comprising a singlearm lever pivotally connected at one end thereof to the piston for pivotal movement about a pivot axis extending normal to the longitudinal axis of the cylinder, and a pair of connecting rods interconnecting the lever and the respective crank-arms of the crankshafts with one of the connecting rods being pivotally connected to the lever at a free end thereof and the other connecting rod pivotally connected to the lever intermediate the ends thereof. The lever together with the connecting rods define a position control means for enabling the lever to pivot and move past the longitudinal axis when the piston reaches the first limit position and to thereby maintain the piston substantially stationary at the first limit position for a period of time sufficient to permit the crank-arm of the aforesaid one crankshaft to move past dead-center.

Thus, substantially maximum compression is achieved in the combustion chamber during a compression stroke of the piston when the piston is at the first limit position while the crank-arm of the aforesaid one crankshaft is positioned past dead-center and the pivotal connections of the connecting rods to the lever are positioned on a side of the longitudinal axis whereat the aforesaid one crankshaft is disposed such that upon combustion of the combustible mixture substantially maximum thrust is imparted to the piston and substantially maximum force is transmitted to the connecting rod connected to the crank-arm of the aforesaid one crankshaft.

Applicant has found quite unexpectedly that by using instead of a rocker member a single-arm lever and pivotally connecting one of the connecting rods to a free end of the lever and the other connecting rod to the lever intermediate the ends thereof, conventional straight connecting rods could be used without these having to cross each other and more working space could be provided within which the lever may pivot. Moreover, the arrangement is such that when the piston reaches the first limit position the lever pivots and moves past the longitudinal axis of the cylinder so as to cause the pivotal connections of the connecting rods to the lever to be positioned on a side of the longitudinal axis whereat the crankshaft having the crank-arm with an angular advance is disposed. As a result, the downward force which is exerted by the piston is transmitted as a single component through the lever directly to the connecting rod connected to the crank-arm which has an angular advance. Thus, substantially maximum force can be transmitted to the connecting rod connected to the crank-arm of the crankshaft having the angular advance.

According to a preferred embodiment of the invention, the lever comprises two arm portions with one of the arm portions extending radially from the pivot axis about which the lever pivots and the other arm portion extending from the one arm portion an angle thereto, for example about 150°. Preferably, the connecting rod which is pivotally connected to the lever intermediate the ends thereof is so connected at the apex defined by the angle formed between the two arm portions.

According to another preferred embodiment of the invention, the angular position of the crank-arm which is given an angular advance is adjusted so that when the piston is at the first limit position and combustion takes place, such crank-arm is positioned at an angle of about 30° past dead-center. Preferably, the angular position of the crank-arm of the other crankshaft is also adjusted so that when the same event occurs it is positioned past dead-center, for example at an angle of about 10°.

The invention enables the efficiency of internal combustion engines to be significantly increased, thus providing substantially greater power output. An internal combustion engine constructed in accordance with the invention may be a single cylinder engine as in the case of lawn mowers or a multicylinder engine as in the case of land vehicles, aircrafts and the like, and can function either on the diesel principle or on the two or four cycle principle.

BRIEF DESCRIPTION OF THE DRAWINGS

Further features and advantages of the invention will become more readily apparent from the following description of a preferred embodiment thereof as illustrated by way of example in the accompanying drawings, wherein.

DESCRIPTION OF PREFERRED EMBODIMENTS

Figure 2:
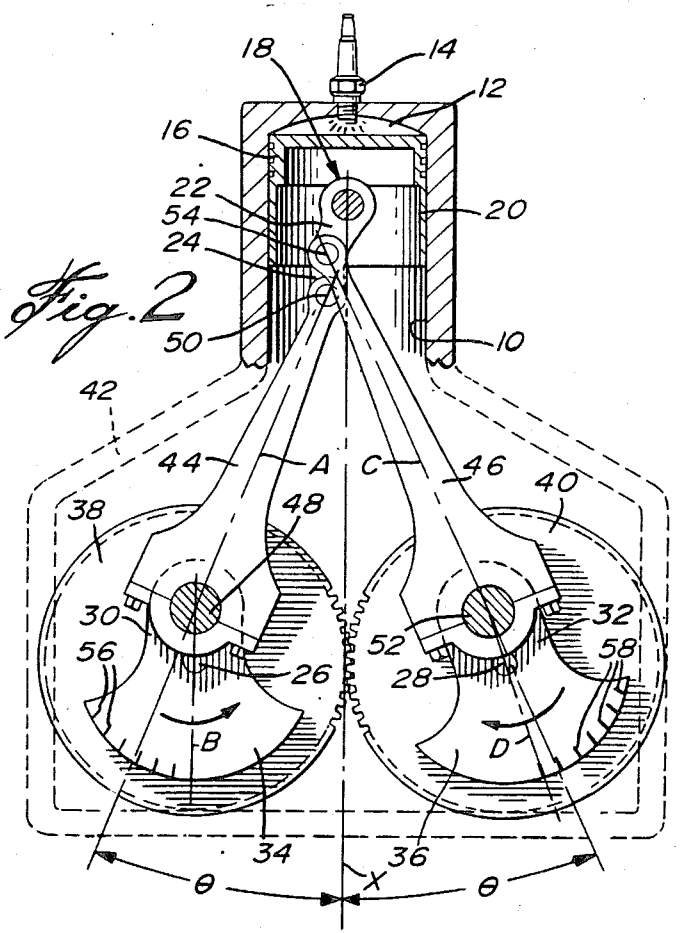
FIGS. 1 to 5 are part-sectioned elevational views taken through an internal combustion engine constructed in accordance with the invention, showing the inner parts thereof during the various phases of their movements.

Referring to FIGS. 1–5 of the drawings, there is illustrated an internal combustion engine having a cylinder 10 defining at its top a combustion chamber 12 adapted to receive through an intake valve (not shown) a combustible mixture for the combustion thereof, the spark plug 14 serving to ignite the combustible mixture. A piston 16 is slidably mounted in the cylinder 10 for vertical reciprocating movement. A single-arm lever 18 is pivotally connected to the piston 16 by means of the wrist-pin 20 for swinging movement relative to the longitudinal axis X of the cylinder 10. The lever 18 is formed with two arm portions 22 and 24 having different lengths, the arm portion 22 being longer than the arm portion 24. The arm portions 22 and 24 are angularly inclined relative to one another with an angle of about 150° being defined therebetween.

A pair of rotatably mounted parallel crankshafts 26 and 28 having respective crank-arms 30 and 32 and respective counterweights 34 and 36 are arranged equidistantly relative to the longitudinal axis X of the cylinder 10. The crankshafts 26 and 28 are coupled together by gear wheels 38 and 40 having a gear ratio of 1:1 and being in meshing engagement with each other to cause the crankshafts to rotate in opposite directions. The gear wheels 38 and 40 which are fixedly connected at their respective centers to the crankshafts 26 and 28 may be located exteriorily of the crankcase 42.

A pair of conventional straight connecting rods 44 and 46 having different lengths interconnect the lever 18 and the respective crank-arms 30 and 32 of the crankshafts 26 and 28. As shown, the shorter connecting rod 44 is pivotally connected at its lower end to the crank-arm 30 by means of the crank-pin 48 and at its upper end to the arm portion 24 of the lever 18 at the free end thereof by means of a pivot pin 50. On the other hand, the longer connecting rod 46 is pivotally connected at its lower end to the crank-arm 32 by means of the crank-pin 52 and at its upper end to the lever 18 at the apex defined by the angle formed between the arm portions 22 and 24, by means of a pivot pin 54.

The angular position of the crank-arm 30 relative to the reference line A intersecting the pivot axes defined by the crank-pin 48 and pivot pin 50 is represented by the line B which intersects the rotation axis of the crankshaft 26 and the pivot axis defined by the crank-pin 48. Similarly, the angular position of the crank-arm 32 relative to the reference line C intersecting the pivot axes defined by the crank-pin 52 and pivot pin 54 is represented by the line D which intersects the rotation axis of the crankshaft 28 and the pivot axis defined by the crank-pin 52. For the sake of simplicity and in order to easily determine the angles between the lines A and B and the lines C and D, a plurality of equally spaced-apart markings 56 and 58 are provided on the counter-weights 34 and 36, respectively, the space between two consecutive markings 56 or 58 corresponding to an angle of about 10°. Thus, when the lines A and B or the lines C and D coincide with each other, that is, the angle defined therebetween is 0°, a dead-center occurs.

In order to avoid the occurrence of a dead-center when the piston 16 is at its uppermost position, the crank-arm 30 is given an angular advance over the crank-arm 32. In other words, the angular position of the crank-arm 30 is adjusted by means of the gear wheel 38 prior to its coupling to the gear wheel 40 so that when the piston 16 is at its uppermost position and combustion takes place as shown in FIG. 2, the crank-arm 30 will be positioned at an angle of, for example, 30° past dead-center, i.e., the line B will define an angle of 30° relative to the reference line A. As shown, the crank-arm 32 is also adjusted so that when the same event occurs it will be positioned past dead-center, for example at an angle of about 10° which corresponds to the angle defined between lines C and D.

Figure 1:
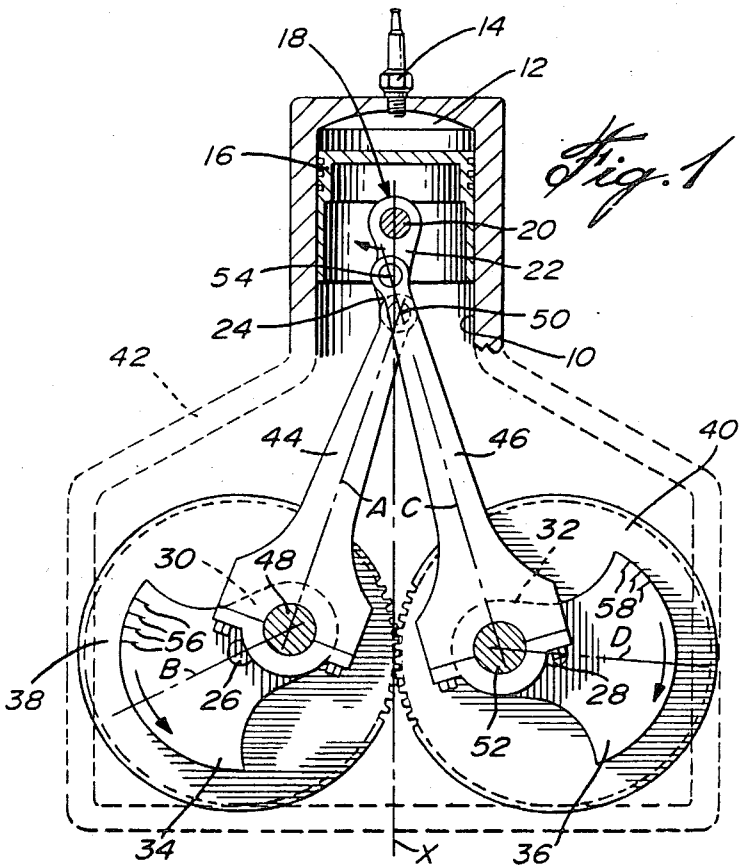

Turning to the operation of the internal combustion engine illustrated, FIG. 1 shows how the lever 18 moves in response to the displacement of the connecting rods 44 and 46 when the piston 16 reaches its uppermost position. As the crankshaft 26 rotates counter-clockwise and the crankshaft 28 rotates clockwise, the connecting rods 44 and 46 both exert a pushing force on the lever 18 to thereby cause the lever to pivot about the wrist-pin 20 in the direction shown by the arrow in FIG. 1 and thus move past the longitudinal axis X. This pivotal movement of the lever 18 enables the piston 16 to remain substantially stationary at its uppermost position while the crankarms 30 and 32 are allowed to move past dead-center to the positions shown in FIG. 2.

As shown in FIG. 2, when the combustible mixture in the combustion chamber 12 is ignited by means of the spark plug 14 and combustion takes place, the piston 16 is still at its uppermost position whereas the crank-arm 30 is at an angular position of about 30° relative to reference line A and the crankarm 32 at an angular position of about 10° relative to reference line C; in other words, the crank-arms 30 and 32 are positioned past dead-center by an angle of 30° and 10°, respectively. Thus, maximum compression is maintained in the combustion chamber 12 so that upon combustion of the combustible mixture maximum thrust is imparted to the piston 16. On the other hand, the pivot pins 50 and 54 are positioned on the side of the longitudinal axis X whereat the crankshaft 26 having the crank-arm 30 with an angular advance of about 30° is disposed. As a result, the downward force which is exerted by the piston 16 is transmitted as a single component through the lever 18 directly to the connecting rod 44 connected to the crank-arm 30. Therefore, maximum force is transmitted to the connecting rod 44 connected to the crank-arm 30 having the angular advance.

The connecting rod angle $\theta$ which is defined between the reference line A or C and the axis X is approximately 23°. Due to such a relatively high angle, the connecting rods 44 and 46 offer much less resistance to the downward force exerted on the piston 16 upon combustion than in conventional engines.

Figure 3:
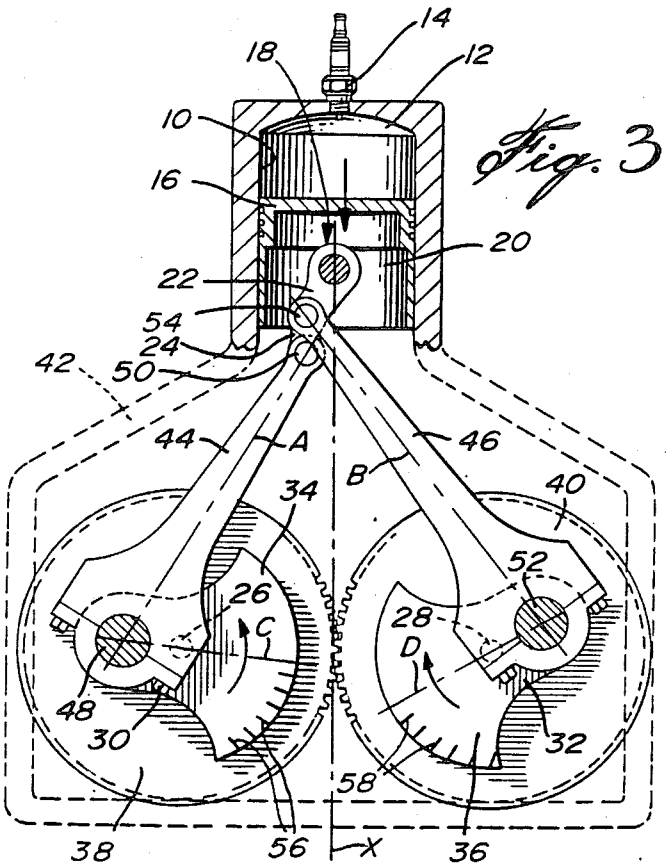

FIG. 3 illustrates the relative positions of the engine parts as the piston 16 moves downwardly after the combustion has taken place. As shown, the crank-arm 30 clearly has an advance over the crank-arm 32 and the pivot pins 50 and 54 are positioned still further away from the longitudinal axis X.

Figure 4:
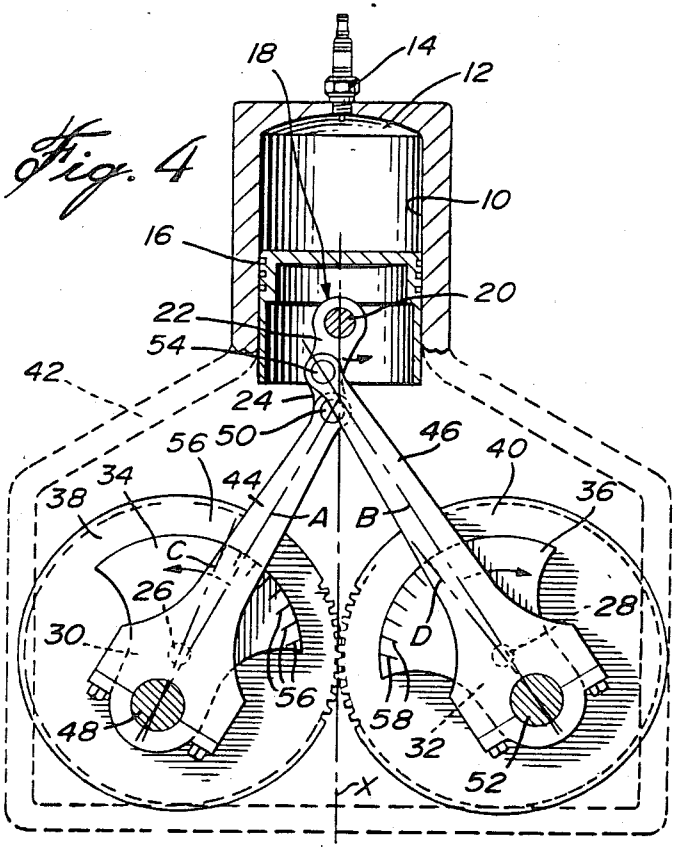
Figure 5:
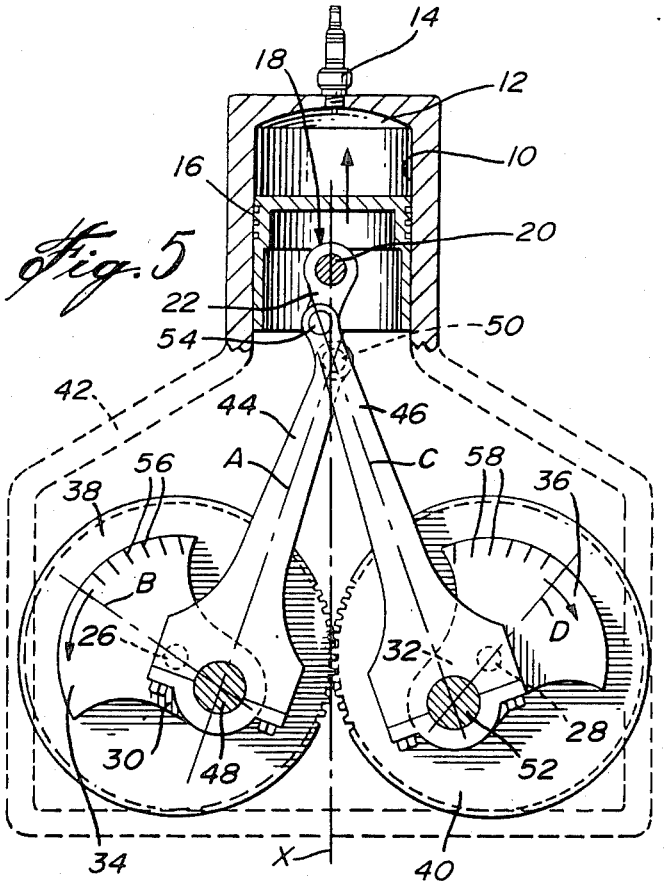

FIG. 4 shows the piston 16 in its lowermost position and the pivotal movement of the lever 18 in the direction indicated by the arrow. After such a pivotal movement of the lever 18, during which the piston 16 remains substantially stationary similarly as in FIG. 1, the piston 16 then moves upwardly as shown in FIG. 5.

Figure 6:
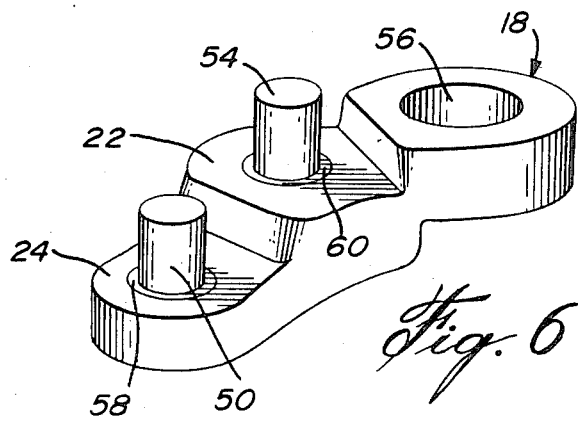
FIG. 6 is a perspective view of the singlearm lever used in the internal combustion engine shown in FIGS. 1–5.
Figure 7:
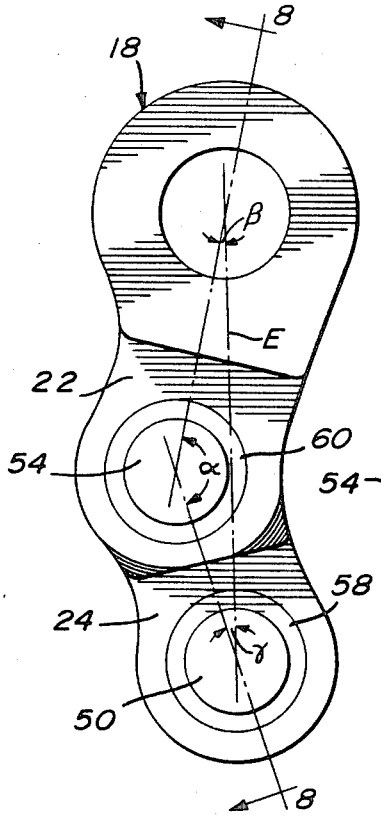
FIG. 7 is a top plan view of the lever illustrated in FIG. 6.
Figure 8:
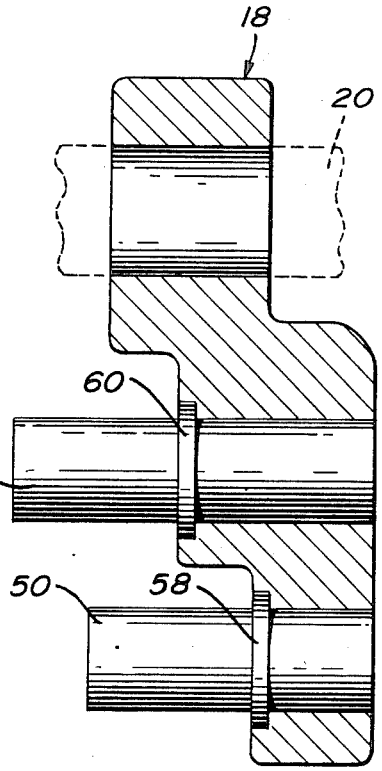
FIG. 8 is a sectional view taken along line 8—8 of FIG. 7.

FIGS. 6–8 illustrate the single-arm lever in more detail. As shown, the lever 18 is formed with a through-hole or bore 56 for receiving the wrist-pin 20 about which the lever pivots. The arm portion 22 of the lever extends radially from the center of the bore 56 whereas the arm portion 24 extends from the arm portion 22 at an angle $\alpha$ thereto, the angle $\alpha$ being about 150°. The arm portion 22 defines an angle $\beta$ of about 13° relative to an imaginary line E intersecting the pivotal connections at the ends of the lever. The arm portion 24, on the other hand, defines an angle $\gamma$ of about 17° relative to the line E.

The arm portion 22 of the lever 18 is longer than the arm portion 24. The arm portions 22 and 24 also extend in different planes to provide spacing for accomodating the respective upper ends of the connecting rods 44 and 46 (not shown). The pivot pins 50 and 54 which serve to pivotally connect the connecting rods 44 and 46 to the lever 18 are press-fitted into suitable bores formed in the lever. They are respectively provided with annular flanges 58 and 60 formed integral therewith and fitted into corresponding annular recesses provided in the lever. The provision of such annular flanges 58 and 60 prevents the pivot pins 50 and 54 from accidentally sliding out of their respective bores.

I claim:

1. In an internal combustion engine including a cylinder defining a combustion chamber adapted to receive a combustible mixture for the combustion thereof, a piston slidably mounted in said cylinder for reciprocating movement between a first limit position whereat the combustion chamber defines its minimum volume and a second limit position whereat the combustion chamber defines its maximum volume, a pair of rotatably mounted parallel crankshafts arranged equidistantly relative to the longitudinal axis of said cylinder and each having a crank-arm rotatable about its respective crankshaft axis, and means coupling said crankshafts together for synchronising the rotation thereof with the crank-arm of one of said crankshafts having an angular advance over the crank-arm of the other crankshaft, the improvement comprising a single-arm lever pivotally connected at one end thereof to said piston for pivotal movement about a pivot axis extending normal to the longitudinal axis of said cylinder, and a pair of connecting rods interconnecting said lever and the respective crank-arms of said crankshafts with one of said connecting rods being pivotally connected to said lever at a free end thereof and the other connecting rod pivotally connected to said lever intermediate the ends thereof, said lever comprising two arm portions of different lengths with one of said arm portions extending radially from the pivot axis about which said lever pivots and the other arm portion extending from said one arm portion at an angle of about 150°, said one arm portion being longer than said other arm portion and defining an angle of about 13° relative to an imaginary line intersecting the pivotal connections at the ends of said lever, said other arm portion and said imaginary line defining therebetween an angle of about 17°, said lever together with said connecting rods defining a position control means for enabling said lever to pivot and move past said longitudinal axis when said piston reaches said first limit position and to thereby maintain said piston substantially stationary at said first limit position for a period of time sufficient to permit the crank-arm of said one crankshaft to move past dead-center, whereby substantially maximum compression is achieved in said combustion chamber during a compression stroke of said piston when said piston is at said first limit position while the crank-arm of said one crankshaft is positioned past dead-center and the pivotal connections of said connecting rods to said lever are positioned on a side of said longitudinal axis whereat said one crankshaft is disposed such that upon combustion of said combustible mixture substantially maximum thrust is imparted to said piston and substantially maximum force is transmitted to the connecting rod connected to the crank-arm of said one crankshaft.

2. In an internal combustion engine including a cylinder defining a combustion chamber adapted to receive a combustible mixture for the combustion thereof, a piston slidably mounted in said cylinder for reciprocating movement between a first limit position whereat the combustion chamber defines its minimum volume and a second limit position whereat the combustion chamber defines its maximum volume, a pair of rotatably mounted parallel crankshafts arranged equidistantly relative to the longitudinal axis of said cylinder and each having a crank-arm rotatable about its respective crankshaft axis, and means coupling said crankshafts together for synchronising the rotation thereof with the crank-arm of one of said crankshafts having an angular advance over the crank-arm of the other crankshaft, the improvement comprising a singlearm lever pivotally connected at one end thereof to said piston for pivotal movement about a pivot axis extending normal to the longitudinal axis of said cylinder, and a pair of connecting rods interconnecting said lever and the respective crank-arms of said crankshafts with one of said connecting rods being pivotally connected to said lever at a free end thereof and the other connecting rod pivotally connected to said lever intermediate the ends thereof, said lever together with said connecting rods defining a position control means for enabling said lever to pivot and move said free end past said longitudinal axis to one side when said piston reaches said first limit position and to thereby maintain said piston substantially stationary at said first limit position for a period of time sufficient to permit the crank-arm of said one crankshaft to move past dead-center, whereby substantially maximum compression is achieved in said combustion chamber during a compression stroke of said piston when said piston is at said first limit position while the crank-arm of said one crankshaft is positioned past dead-center and the pivotal connections of said connecting rods to said lever are positioned off to said one side of said longitudinal axis whereat said one crankshaft is disposed such that upon combustion of said combustible mixture substantially maximum thrust is imparted to said piston and substantially maximum force is transmitted to the connecting rod connected to the crank-arm of said one crankshaft.

3. An internal combustion engine as claimed in claim 2, wherein said coupling means comprise a pair of gear wheels each fixedly connected at its respective center to a respective one of said crankshafts, said gear wheels having a gear ratio of 1:1 and being in meshing engagement with each other to cause said crankshafts to rotate in opposite directions.

4. An internal combustion engine as claimed in claim 1, wherein said lever comprises two arm portions with one of said arm portions extending radially from the pivot axis about which said lever pivots and the other arm portion extending from said one arm portion at an angle thereto.

5. An internal combustion engine as claimed in claim 4, wherein the angle defined between said arm portions is about 150°.

6. An internal combustion engine as claimed in claim 5, wherein said arm portions have different lengths, said one arm portion being longer than said other arm portion.

7. An internal combustion engine as claimed in claim 4, wherein said one connecting rod is pivotally connected at a first end thereof to the crank-arm of said one crankshaft and at a second end thereof to said free end of said lever, and wherein said other connecting rod is pivotally connected at a first end thereof to the crank-arm of said other crankshaft and at a second end thereof to said lever at the apex defined by the angle formed between said arm portions.

8. An internal combustion engine as claimed in claim 7, wherein said one arm portion and said other arm portion of said lever extend in different planes to provide spacing for accommodating the respective second ends of said connecting rods.

9. An internal combustion engine as claimed in claim 7, wherein said one connecting rod has a shorter length relative to said other connecting rod.

10. An internal combustion engine as claimed in claim 7, wherein when said piston is at said first limit position and combustion takes place the crank-arm of said one crankshaft is at an angular position of about 30° relative to a first reference line intersecting the pivotal connections of said one connecting rod at said first and second ends thereof.

11. An internal combustion engine as claimed in claim 10, wherein when said piston is at said first limit position and combustion takes place, the crankarm of said other crankshaft is at an angular position of about 10° relative to a second reference line intersecting the pivotal connections of said other connecting rod at said first and second ends thereof.

12. An internal combustion engine as claimed in claim 11, wherein when said piston is at said first limit position and combustion takes place said first and second reference lines each define an angle of about 23° relative to the longitudinal axis of said cylinder.

* * * * *